US005090054A

United States Patent [19]

Grilliot et al.

[11] Patent Number: 5,090,054

[45] Date of Patent: * Feb. 25, 1992

[54] VENTILATED HOOD FOR FIREFIGHTER

[76] Inventors: William L. Grilliot; Mary I. Grilliot, both of 1986 Home Ave., Dayton, Ohio 45417

[ * ] Notice: The portion of the term of this patent subsequent to Nov. 27, 2007 has been disclaimed.

[21] Appl. No.: 616,617

[22] Filed: Nov. 21, 1990

Related U.S. Application Data

[63] Continuation of Ser. No. 358,155, May 26, 1989.

[51] Int. Cl.[5] ..... A42B 3/28

[52] U.S. Cl. ..... 2/5; 2/7; 2/8; 2/202; 2/410

[58] Field of Search ..... 2/5, 7, 8, 171, 202, 2/203, 204, 205, 410, 423

[56] References Cited

U.S. PATENT DOCUMENTS

| | | | |
|---|---|---|---|
| 296,438 | 4/1884 | Newton | 2/7 |
| 682,455 | 9/1901 | Cooper | 2/5 |
| 1,699,133 | 1/1929 | Bullard | 2/5 |
| 1,810,157 | 6/1931 | Bullard | 2/410 |
| 1,860,690 | 5/1932 | Rateau | 2/5 |
| 3,458,864 | 8/1969 | Austin | 2/5 |
| 3,594,814 | 7/1971 | Schuessler | 2/205 |
| 4,768,235 | 9/1988 | Webster | 2/202 |
| 4,829,599 | 5/1989 | Giorgio | 2/423 |

FOREIGN PATENT DOCUMENTS

| | | | |
|---|---|---|---|
| 118354 | 7/1930 | Fed. Rep. of Germany | 2/7 |
| 3110593 | 10/1982 | Fed. Rep. of Germany | 2/410 |
| 50757 | 3/1941 | France | 2/8 |
| 51504 | 4/1922 | Sweden | 2/8 |
| 501171 | 4/1976 | U.S.S.R. | 2/410 |
| 700753 | 11/1979 | U.S.S.R. | 2/410 |
| 453284 | 9/1936 | United Kingdom | 2/8 |
| 529716 | 11/1940 | United Kingdom | 2/7 |
| 1456824 | 11/1976 | United Kingdom | 2/410 |
| 2075820 | 11/1981 | United Kingdom | 2/5 |

OTHER PUBLICATIONS

Morning Pride, Morning Pride Mfg. Inc., Dayton, Ohio, Aug. 1, 1988, p. 30.

*Primary Examiner*—Werner H. Schroeder
*Assistant Examiner*—Diana L. Biefeld
*Attorney, Agent, or Firm*—Jacox & Meckstroth

[57] ABSTRACT

A firefighter's hood which covers the upper portion of a firefighter. The hood normally has a shoulder section and a neck section and a head section, to cover those portions of the firefighter. The head section covers the head of the firefighter and has an opening to expose the face of the firefighter. The major part of the head section is made of thermal barrier material having given heat insulation qualities. However, the head section has an upper part which is adapted to be positioned at the upper portion of the head of the firefighter who wears the hood. The upper part of the head section of the hood has significantly less heat insulation qualities, so that heat can escape from the head of the firefighter and thus stress upon the firefighter which results from heat is reduced.

8 Claims, 1 Drawing Sheet

VENTILATED HOOD FOR FIREFIGHTER

RELATED APPLICATION

This application is a continuation of patent application Ser. No. 07/358,155, filed May 26, 1989 and is incorporated herein by reference.

BACKGROUND OF THE INVENTION

Conventionally a firefighter wears a hood which covers the head, neck and shoulder regions of the firefighter. The hood has a front opening for exposure of the face of the firefighter. The hood eliminates the possibility of a gap in the protective envelope around the neck, cheek, and ears between the helmet, face mask and coat collar of the firefighter. The hood is constructed of thermal barrier material. Thus, the hood serves a valuable function in protecting the firefighter against burns in the regions covered by the hood.

A problem exists with regard to the hood of the firefighter. Stress is the leading cause of injuries and deaths of firefighters. Heat generated within the firefighter's garments produces significant stress upon the firefighter. Conventional hoods for firefighters cover and enclose the head of the firefighter with thermal barrier material. Therefore, a significant amount of heat is trapped within the head region of the firefighter, as the hood covers the head of the firefighter. This is unfortunate in view of the fact that physiologists have verfied that the head is a primary area for body heat release as a result of blood "pooling" in this area. Of course, if heat is permitted to escape from the head of the firefighter the magnitude of the stress upon the firefighter is greatly reduced.

It is an object of this invention to provide a firefighter's hood which permits heat to escape from the firefighter's head, while permitting the hood to maintain its traditional and conventional thermal protection to the firefighter. Thus, stress upon the firefighter is reduced while providing no reduction in thermal protection to the firefighter's neck, cheek, and ears.

Other objects and advantages of this invention reside in the construction of the firefighter's hood, the combination of parts of the hood, the method of production of the hood and the mode of use of the hood, as will become more apparent from the following description.

SUMMARY OF THE INVENTION

A firefighter wears a hood which is positioned under a helmet which is also worn by the firefighter.

This invention provides a firefighter's hood which protects the firefighter's head, neck, and shoulder regions in a conventional manner, while also providing means by which the firefighter's head is ventilated. The firefighter's hood of this invention includes means which establish an opening in the upper portion of the hood for escape of heat from the upper part of the firefighter's head. Thus, there is ventilation of the head portion of the firefighter. A firefighter's hood of this invention includes a head section having major portion of thermal insulation material. The upper portion of the head section comprises any material or means having lesser thermal insulation qualities than the major portion of the head section. The upper portion of the head section of the hood may be completely open, or the upper portion of the head section may comprise net material having a multiplicity of openings therethrough, or the upper portion may comprise means having several openings therein. The upper portion of the head section may be completely open to expose the upper part of the head of the firefighter. Therefore, heat within the head portion of the firefighter can escape upwardly through the upper portion of the head section of the hood. Thus, the head portion of the firefighter is ventilated and stress upon the firefighter is reduced. However, the firefighter's hood of this invention provides conventional protection to the firefighter.

DETAILED DESCRIPTION OF THE PREFERRED EMBODIMENTS OF THE INVENTION

Figure 1:
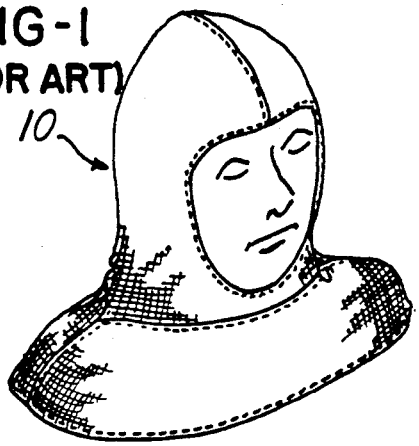
FIG-1 (PRIOR ART)
FIG. 1 is a perspective view illustrating the prior art in regard to a firefighter's hood.

A conventional firefighter's hood 10 is shown in FIG. 1. The hood 10 is constructed of thermal barrier or thermal insulation material and customarily comprises a plurality of layers of thermal barrier or thermal insulation material. The hood 10 covers the head, neck, and shoulders of a firefighter. The hood 10 has a front opening which exposes the face of the firefighter. The conventional firefighter's hood 10 is of the same thermal insulation material throughout all portions thereof.

Figure 2:
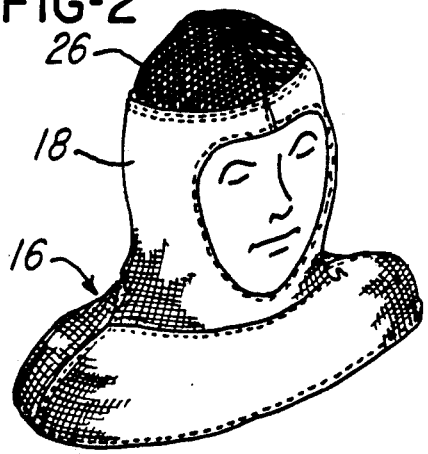
FIG. 2 is a perspective view, similar to FIG. 1, and drawn on substantially the same scale as FIG. 1, illustrating a firefighter's hood of this invention.
Figure 3:
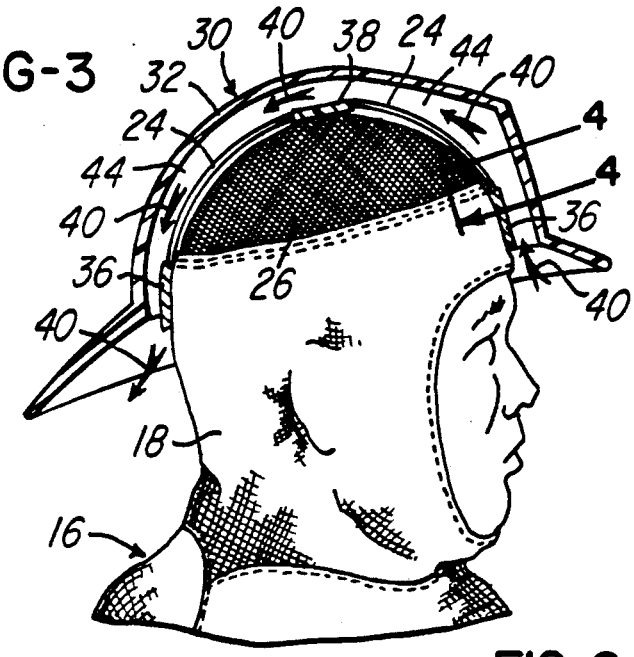
FIG. 3 is a fragmentary side sectional view drawn on a larger scale than FIGS. 1 and 2, showing a firefighter's helmet and the firefighter's hood of FIG. 2.
Figure 4:
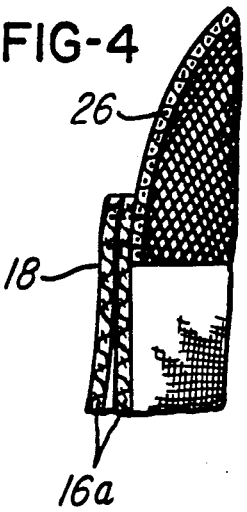
FIG. 4 is an enlarged fragmentary sectional view taken substantially on line 4—4 of FIG. 3.

FIGS. 2 and 3 illustrates a firefighter's hood 16 of this invention. The hood 16 comprises shoulder and neck sections. The hood 16 also includes a head section 18. The head section 18 has a front opening through which the firefighter's face is exposed. The hood 16 may comprise a plurality of layers **16*a*, as best shown in FIG. 4. The upper part of the head section 18 includes a net portion 26, which is attached to the layers 16*a*, as shown in FIG. 4. The net portion 26** has a multiplicity of openings therethrough.

The firefighter wears a helmet 30, which has a rigid shell 32. Within the rigid shell 32 is a plurality of spaced-apart straps 24 which have parts, attached to a head band 36, which is attached to the rigid shell 32 by means not shown. The straps 24 may, for example, comprise two strap members which are arranged at right angles, one to the other, and are spaced from the rigid shell 32. Attached to the straps 24 is a pad 38. The spaces between the straps 24 establish a plurality of large openings between the net portion 26 of the head section 18 and the rigid shell 32. Therefore, heat can escape upwardly from the firefighter's head, through the net portion 26 and through the openings between the spaced-apart straps 24. The heat then travels into a channel 44 which exists between the straps 24 and the rigid shell 32. As illustrated by arrows 40 in FIG. 3, air can flow within the helmet 30 and within the channel 44 between the straps 24 and the rigid shell 32. Thus, the heat travels within the channel 44 and from the helmet 30. Therefore, heat readily flows upwardly from the head of the firefighter and travels outwardly from the helmet 30.

Figure 5:
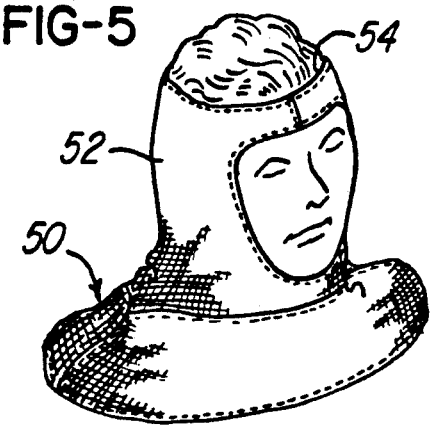
FIG. 5 is a perspective view, similar to FIGS. 1 and 2 and drawn on substantially the same scale as FIGS. 1 and 2, and showing another embodiment in a firefighter's hood of this invention.

FIG. 5 illustrates another embodiment of the firefighter's hood of this invention. FIG. 5 shows a hood 50 which has shoulder and neck sections. The hood 50 also includes a head section 52. The front part of the head section 52 has an opening therein which exposes the face of the firefighter. The upper part of the head section 52 of the hood 50 has an opening 54 which exposes the upper part of the head of the firefighter.

Thus, when the firefighter's head is within a helmet, such as the helmet 30, heat escapes upwardly from the head of the firefighter, through the opening 54, through the space formed by the straps 24, and into the channel 44 between the straps 24 and the rigid shell 32. Thus, heat readily flows from the head of the firefighter and outwardly from the helmet 30.

Figure 6:
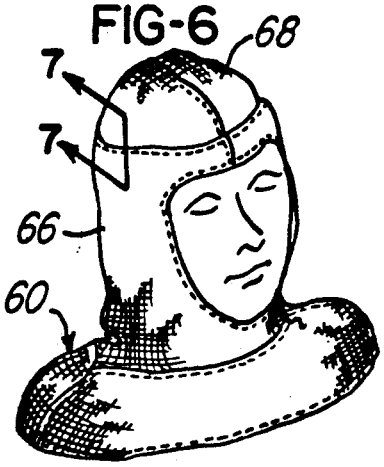
FIG. 6 is a perspective view, similar to FIGS. 1, 2, and 5 and drawn on substantially the same scale as FIGS. 1, 2, and 5, and showing another embodiment in a firefighter's hood of this invention.
Figure 7:
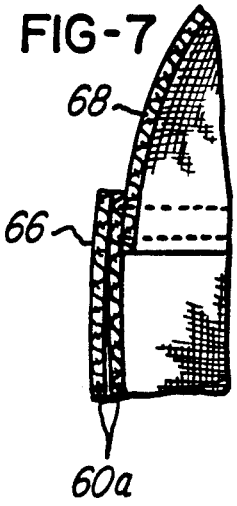
FIG. 7 is an enlarged fragmentary sectional view taken substantially on line 7—7 of FIG. 6.

FIGS. 6 and 7 show another embodiment of the firefighter's hood of this invention. A hood 60 shown in FIGS. 6 and 7 comprises layers 60*a* of thermal insulation material and includes shoulder and neck sections. The hood 60 also includes a head section 66. The head section 66 has an opening which exposes the face of the firefighter. The upper part of the head section 66 includes a section 68 of covering material which is attached to the layers 60*a*. The section 68 of covering material is a significantly lighter material than the layers 60*a* and is significantly more porous than the layers 60*a*. Therefore, when the firefighter wears a helmet, such as the helmet 30, heat can flow upwardly from the head of the firefighter through the section 68 of covering material through the openings formed by the straps 24 and into the channel 44 at the upper part of the outer shell 32. Thus, heat flows from the head of the firefighter and from the helmet 30.

Thus, it is understood that a firefighter's hood of this invention provides thermal protection to the head, shoulders, and neck regions of a firefighter while also providing ventilation to the head of the firefighter by permitting heat to flow from the head of the firefighter and from the firefighter's helmet.

Although the preferred embodiments of the ventilated hood for firefighters of this invention have been described, it will be understood that within the purview of this invention various changes may be made in the form, details, proportion and arrangement of parts, the combination thereof, and the mode of use, which generally stated consist in a structure and method within the scope of the appended claims.

The invention having thus been described, the following is claimed:

1. A firefighter's hood and helmet combination for the head of a firefighter who wears a firefighter's helmet, the firefighter's helmet including a rigid shell, the rigid shell having an internal portion, spacer means within the internal portion of the rigid shell and attached to the rigid shell, the spacer means including an annular part within the internal portion of the rigid shell and spaced from the rigid shell, the spacer means including a cross member within the internal portion of the rigid shell and spaced from the rigid shell and extending between opposed portions of the annular part, the annular part being adapted to encompass the head of the firefighter who wears the firefighter's hood and helmet combination, the cross member being adapted to extend over the head of the firefighter who wears the hood and helmet combination, whereby the spacer means provide a space between the rigid shell and all portions of the head of the firefighter who wears the firefighter's helmet, whereby the rigid shell is spaced from the head of the firefighter who wears the firefighter's helmet and whereby a channel is provided between the head of the firefighter and the rigid shell, the firefighter's hood comprising thermal barrier material having given thermal insulation qualities to protect the firefighter against environmental heat, the firefighter's hood including an enclosure section which closely encompasses the head of the firefighter who wears the firefighter's hood, the enclosure section having a facial exposure portion, the firefighter's hood also including an upper section which is positioned at the upper part of the head of the firefighter who wears the firefighter's hood and whose head is encompassed by the enclosure section of the firefighter's hood, the upper section of the firefighter's hood having thermal insulation qualities which are significantly less than the given thermal insulation qualities, whereby the head of the firefighter has thermal insulation protection and whereby heat escapes from the upper part of the head of the firefighter who wears the firefighter's hood as the heat flows through the upper section of the firefighter's hood, the heat escaping into the channel between the rigid shell and the head of the firefighter, whereby the heat flows from the head of the firefighter and from the firefighter's helmet, and whereby stress upon the firefighter which results from heat is minimal.

2. The firefighter's hood and helmet combination of claim 1 in which the upper section of the firefighter's hood has an opening therein.

3. The firefighter's hood and helmet combination of claim 1 in which the upper section of the firefighter's hood comprises mesh material having a multiplicity of openings therethrough.

4. A firefighter's hood and helmet combination for the head of a firefighter, the firefighter's helmet including a rigid shell having an internal portion, spacer means within the internal portion of the rigid shell and attached to the rigid shell and spaced from the rigid shell, whereby the spacer means encompasses the head of the firefighter who wears the firefighter's helmet, whereby a space is provided between the head of the firefighter and the rigid shell and whereby a peripheral channel region is formed between the rigid shell and the head of the firefighter who wears the firefighter's hood and firefighter's helmet, the firefighter's hood including thermal barrier material which protects the firefighter against high heat conditions, the firefighter's hood including a neck portion which closely encompasses and covers the neck of the firefighter, the firefighter's hood also including a shoulder portion which closely encompasses and covers the shoulders and upper back and upper chest portion of the firefighter who wears the firefighter's hood, the firefighter's hood also including a head portion which closely encompasses and covers the entire head of the firefighter but which has a facial portion which exposes a part of the face of the firefighter, the firefighter's hood having an upper part which includes means providing a flow passage region positioned at the top of the head of the firefighter who wears the firefighter's hood, whereby the head of the firefighter has heat insulation protection while also being ventilated for escape of heat from the head of the firefighter as heat flows through the flow passage region and into the peripheral channel region between the head of the firefighter and the rigid shell and outwardly from the helmet through the peripheral channel region, whereby stress upon the firefighter which results from heat is minimal.

5. A firefighter's hood and helmet combination for the head of a firefighter who wears a firefighter's helmet, in which the firefighter's helmet includes a rigid shell, having an internal portion, spacer means attached to the rigid shell within the internal portion of the rigid shell and spaced from the rigid shell, whereby the spacer means encompasses the head of the firefighter who wears the firefighter's helmet, whereby a space is provided between the head of the firefighter and the rigid shell and whereby a peripheral channel region is formed between the rigid shell and the head of the firefighter who wears the firefighter's hood and firefighter's helmet, the firefighter's hood including thermal barrier material having given thermal insulation qualities as the firefighter's hood protects the firefighter against high heat conditions, the firefighter's hood also including a head portion which closely encompasses and covers the entire head of the firefighter but which has a facial portion which exposes a part of the face of the firefighter, the firefighter's hood having an upper part which includes means providing a flow passage region positioned at the top of the head of the firefighter who wears the firefighter's hood, the flow passage region having thermal insulation qualities less than the given thermal insulation qualities, whereby the head of the firefighter has heat insulation protection while also being ventilated for escape of heat from the head of the firefighter as heat flows from the head of the firefighter through the flow passage region and into the peripheral channel region between the head of the firefighter and the rigid shell and outwardly from the helmet through the peripheral channel region, whereby stress upon the firefighter which results from heat is minimal.

6. A method of constructing a firefighter's helmet and hood combination which is adapted to be worn upon the head of a firefighter, comprising providing a rigid shell having an internal portion, attaching spacer means to the internal portion of the rigid shell, the spacer means including an annular portion within the internal portion of the rigid shell and spaced from the rigid shell, the spacer means also including a cross portion spaced from the rigid shell and within the internal portion of the rigid shell and extending between opposed parts of the annular portion, whereby the annular portion encompasses the head of the firefighter who wears the firefighter's helmet, and whereby the cross portion extends over the head of the firefighter who wears the firefighter's helmet, the spacer means thus spacing all portions of the rigid shell from the head of the firefighter who wears the firefighter's helmet, whereby a peripheral channel region is provided between the head of the firefighter and the rigid shell, the method also comprising forming thermal barrier material having given insulation qualities into a cover element which closely encompasses the entire head of the firefighter to protect the head of the firefighter against environmental heat, providing the cover element with a facial portion which exposes at least a part of the face of the firefighter, providing the cover element with an upper section which is positioned at the upper part of the head of a firefighter whose head is encompassed by the cover element, providing the upper section of the cover element with means having significantly less insulation qualities than the given insulation qualities, whereby the head of the firefighter is protected by the rigid shell and by the cover element against atmospheric heat and whereby the upper part of the head of the firefighter is ventilated and heat escapes from the head of the firefighter through the upper section of the cover element into the peripheral channel region between the head of the firefighter and the rigid shell, and whereby the heat flows from the rigid shell through the peripheral channel region, and whereby stress upon the firefighter which results from heat is minimal.

7. The method of claim 6 which includes providing the cover element with a neck section which is adapted to closely cover the neck of the firefighter whose head is encompassed by the cover element.

8. The method of claim 6 which includes providing the upper section of the cover element with mesh material having a multiplicity of openings through which heat escapes from the head of the firefighter whose head is encompassed by the cover element.

* * * * *